United States Patent [19]

Shaffer

[11] 4,189,276

[45] Feb. 19, 1980

[54] SIDE LOADING ULTRA-NARROW AISLE LIFT TRUCK

[75] Inventor: Walter M. Shaffer, Peoria, Ill.

[73] Assignee: Caterpillar Tractor Co., Peoria, Ill.

[21] Appl. No.: 801,484

[22] Filed: May 31, 1977

Related U.S. Application Data

[63] Continuation of Ser. No. 650,587, Jan. 19, 1976, abandoned.

[51] Int. Cl.[2] ..... B66F 9/14

[52] U.S. Cl. ..... 414/659; 212/145

[58] Field of Search ..... 212/145; 280/763–766; 414/592, 659; 214/730–731, 660, 670–674, 75 R, 75 G, 75 H, 169 A

[56] References Cited

U.S. PATENT DOCUMENTS

| | | | |
|---|---|---|---|
| 2,709,017 | 5/1955 | Ulinski | 214/730 |
| 3,193,110 | 7/1965 | Bamford | 212/145 |
| 3,199,696 | 8/1965 | Chrysler et al. | 214/75 R |
| 3,219,210 | 11/1965 | Loef | 214/75 R |
| 3,227,287 | 1/1966 | Butcher | 212/145 |
| 3,436,095 | 4/1969 | Preston | 280/766 |
| 3,762,588 | 10/1973 | Hansen et al. | 215/730 |
| 3,948,356 | 4/1976 | Keene | 214/730 X |
| 3,998,345 | 12/1976 | Fiehler et al. | 214/730 X |

FOREIGN PATENT DOCUMENTS

| | | | |
|---|---|---|---|
| 1051735 | 2/1959 | Fed. Rep. of Germany | 214/730 |
| 1129108 | 5/1962 | Fed. Rep. of Germany | 214/670 |
| 2144786 | 3/1973 | Fed. Rep. of Germany | 214/730 |
| 1278612 | 11/1961 | France | 212/145 |

*Primary Examiner*—Stephen G. Kunin
*Assistant Examiner*—R. B. Johnson
*Attorney, Agent, or Firm*—Hugh D. Finley

[57] ABSTRACT

An ultra-narrow aisle lift truck vehicle has a body including discrete front and rear portions connected by a pair of elongated stabilizing and support members. The stabilizing and support members are movable vertically in tracks on the body portions so that they provide both structural support and integrity between the front and rear portions as well as being selectively movable into and out of a ground engaging position to perform a stabilizing function. A pair of vertical masts mounted on the front and rear portions support a vertically movable carriage assembly. The carriage assembly includes a carriage having a pair of horizontally directed forks thereon which may extend into laterally adjacent opposite sides of the vehicle and return to a position within the body and between the lateral sides thereof. The carriage is mounted on an extension pantograph and is turnable about a vertical axis by means of a motor to accommodate such lateral positioning.

3 Claims, 7 Drawing Figures

55'
64'
64'

60
55
64
64
68
72
68
62
62
30
32
51'
34
20
36
V
92
51
82
74
80
80
54
16
14
12
46
76
78
52
L
107
108
18
108
107

SIDE LOADING ULTRA-NARROW AISLE LIFT TRUCK

This is a continuation, of Ser. No. 650,587, filed Jan. 19, 1976, now abandoned.

BACKGROUND OF THE INVENTION

This invention relates to a lift truck for use in ultra-narrow aisle applications. More particularly, this invention is directed to such a lift truck vehicle having a carriage which is extendable from laterally opposite sides of the vehicle and positioned within the vehicle.

In lift truck vehicle operations, a truck capable of narrow aisle applications is frequently called for. In narrow aisle applications, the lift truck vehicle must negotiate a very narrow aisle to retrieve and deposit loads both in that level and in higher load spaces, usually on multi-tier racks.

It is very desirable in such lift truck vehicles to have the capability of loading and unloading to both lateral sides of the vehicle. At the same time, it is also desirable that loads be retractable within the body outline of the vehicle so that the vehicle is no wider than absolutely necessary. One device for accomplishing these desirable functions is shown in U.S. Pat. No. 2,989,202 to Canniere et al. Another such device is shown in U.S. Application Ser. No. 650,586, filed Jan. 19, 1976, now abandoned, assigned to the assignee hereof. With both of these devices, a carriage mounting a pair of forks is traversable into load spaces on laterally opposite sides of the vehicle.

SUMMARY AND OBJECTS OF THE INVENTION

The instant invention provides an improved construction wherein loads may be laterally traversed, while at the same time being stabilized during such movement. The invention takes the form of a lift truck vehicle having a body including front and rear discrete body portions. The body portions thus described are connected for stability and support by means of a pair of generally elongated members. The members are vertically movable by rollers within tracks in the front and rear body portions mounted at the extremities of the members. The members may be lowered into ground engaging relation so that the vehicle body is stabilized when a load is traversed on the carriage to laterally opposite sides of the vehicle.

The vehicle mounts a pair of masts which in turn mount a vertically movable carriage support assembly of inverted U-shaped configuration. Pivotally mounted to the thus described carriage support assembly is a rotatable carriage support assembly, also of inverted, generally U-shaped configuration. A motor mechanically connected intermediate the two carriage support assemblies provides for rotation of a carriage which is mounted on a pantograph arrangement to the rotatable carriage support assembly. The carriage mounts a pair of load forks for handling loads. The vertically movable carriage support assembly may be raised and lowered by means of a lift mast mechanism associated with the extensible lift masts.

The lateral support and stabilizer members can be moved to an uppermost position wherein the carriage may be traversed under the elongated stabilizing and support member. In this manner, loads in close proximity to the ground may be accommodated.

It is therefore an object of this invention to provide an ultra-narrow aisle lift truck which is capable of loading and unloading from laterally opposite sides of the vehicle.

It is a further object of this invention to provide such a lift truck vehicle having stabilizing and support members which are selectively engageable with the ground support surface.

It is a further object of this invention to provide such a lift truck vehicle having a carriage which is extensible from laterally opposite sides of the vehicle to pick up and deposit loads, and which is retractable to a position within the envelope defined by the vehicle.

It is a further object of this invention to provide such a lift truck vehicle having a rotatable pantograph assembly mounting the carriage so that the load may be retracted within the vehicle body envelope and rotated within a vertical axis.

It is a further object of this invention to provide such a lift truck vehicle having a vertically extensible mast so that higher loads may be accommodated.

These and other objects will become more readily apparent from a review of the accompanying drawings and following description.

DETAILED DESCRIPTION

Figure 1:
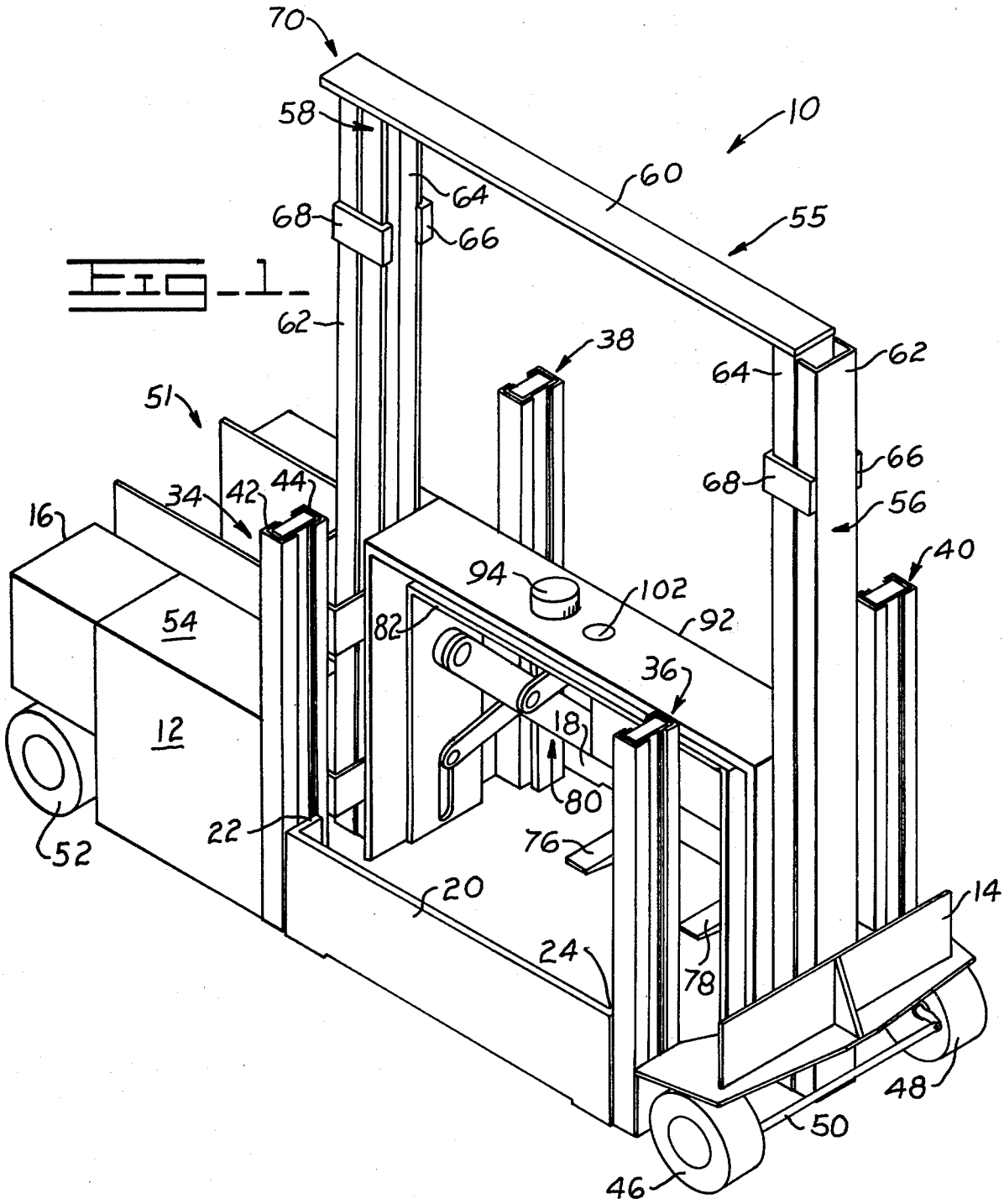
FIG. 1 is a top-quarter isometric view of a lift truck vehicle according to the instant invention.

Turning to FIG. 1, there is shown generally at 10 a lift truck vehicle according to the instant invention. The vehicle has front and rear ends, including a body 12 comprising a front body portion 14 and a rear body portion 16. The front and rear body portions are connected together by means of generally elongated left and right outrigger and support members 18, 20. Each outrigger and support member is of generally U-shaped configuration, having a pair of inwardly directed horizontal arms 22, 24.

Figure 2:
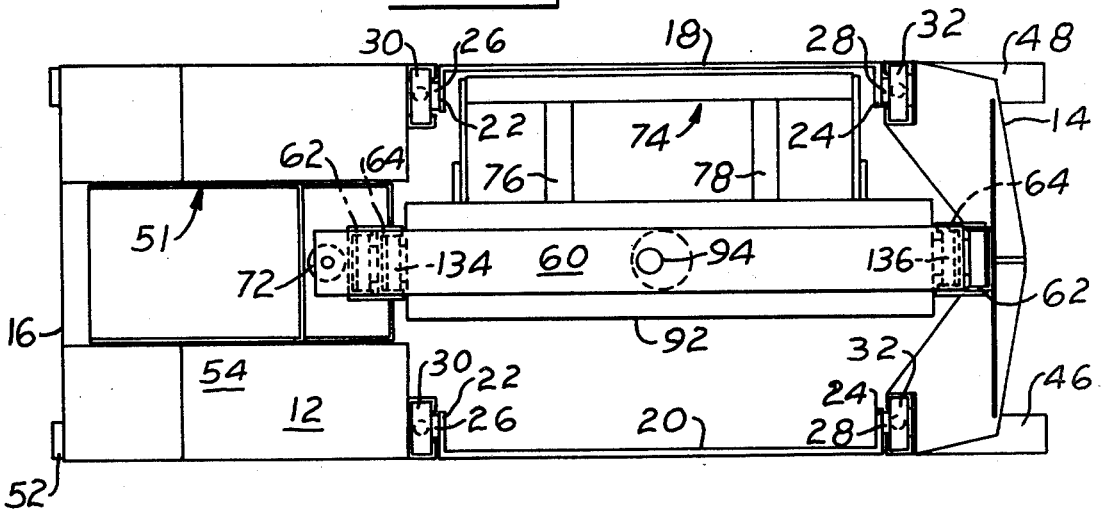
FIG. 2 is a top plan view of the same.

As perhaps best seen in FIG. 2, horizontal arms 22,24 are each connected by means of shafts 26,28 to movable uprights 30,32, respectively. Each of the movable uprights 30,32 is telescopically contained for vertical movement within telescoping uprights 34,36,38,40. Each upright is in turn comprised of a pair of nesting C-shaped channel members, as for example at 42,44, as best seen in FIG. 1.

Front body portion 14 is mounted on a pair of front wheels 46,48, which are connected by means of a steering arm 50 for simultaneous movement thereof. A steering mechanism (not shown) causes the steering arm to move by means of a steering wheel (not shown) located in an operator's station 51 on the rear body portion 16. Similarly, the rear body portion is supported by a pair of wheels, one of which is seen at 52. Wheel 52 is a drive wheel and is driven by means of a motor contained within the rear body portion, generally at 54.

Motive control means (not shown) are also contained within the operator station 51. Control means (not shown) for the outrigger and support members 18,20 are also located within the operator station 51. Operation of the outrigger and support overhead members is also accomplished by means of power control means in the operator station (not shown).

A mast assembly, generally shown at 55, is comprised of front and rear telescoping masts 56,58, interconnected by a cross member 60. Each of the masts is in turn comprised of an outer member 62 and an inner member 64. Guides 66,68 on the mast assembly serve to channel the inner mast with respect to the outer mast.

The cross member 60 extends beyond rear outer mast 58, shown at 70, so that a hydraulic cylinder 72 generally parallel to the mast serves to power or elevate the inner mast and cross member with respect to the outer mast. As perhaps best seen in FIG. 4, the entire mast assembly 55 may be raised to an elevated position for loading and unloading from higher tiers as seen in 55'. A power and control means (not shown) is also contained at operator station 51 for effecting this function. The raising of the masts causes operator station 51 which is attached thereto to be raised as shown at 51'.

Figure 3:
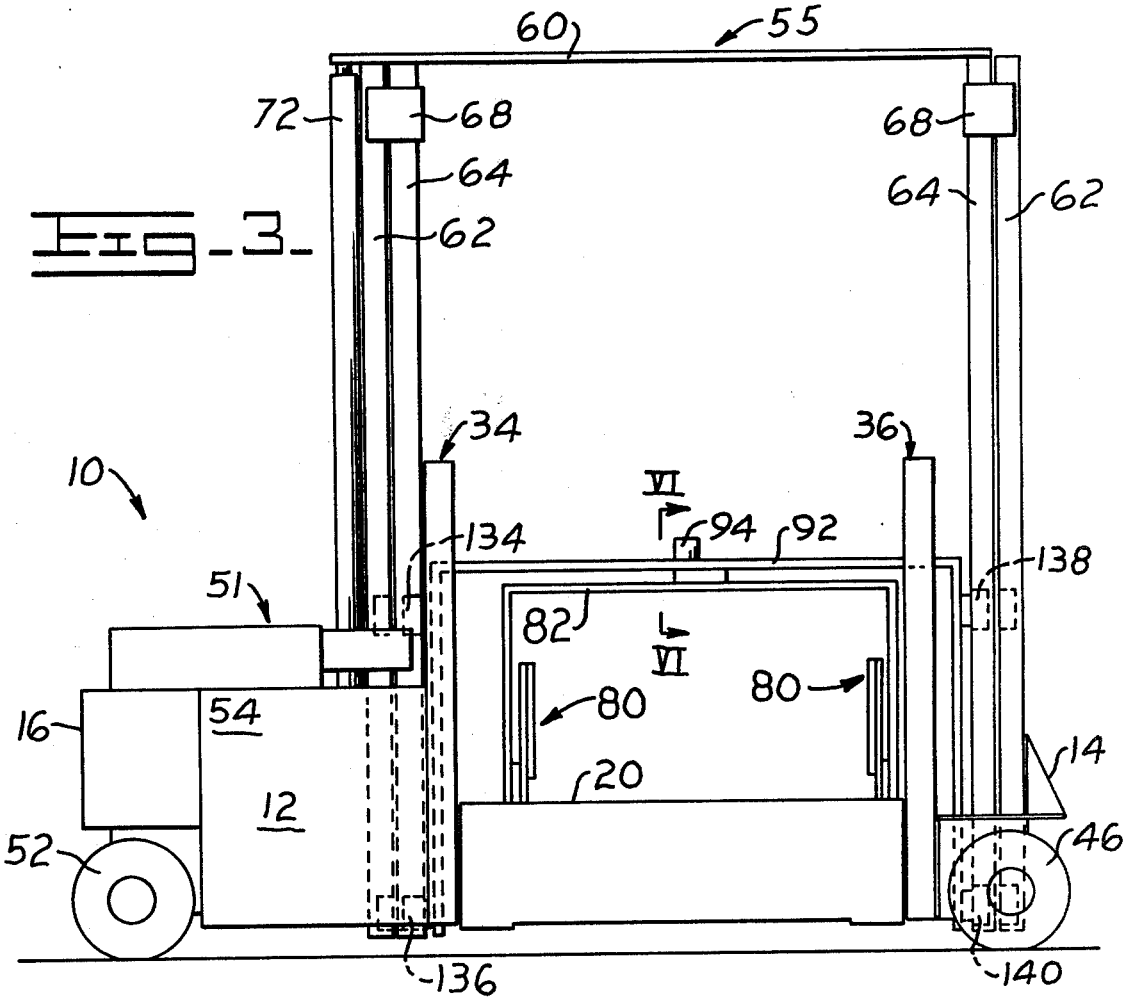
FIG. 3 is a side elevation view of the same, with the load in the roading phase.
Figure 4:
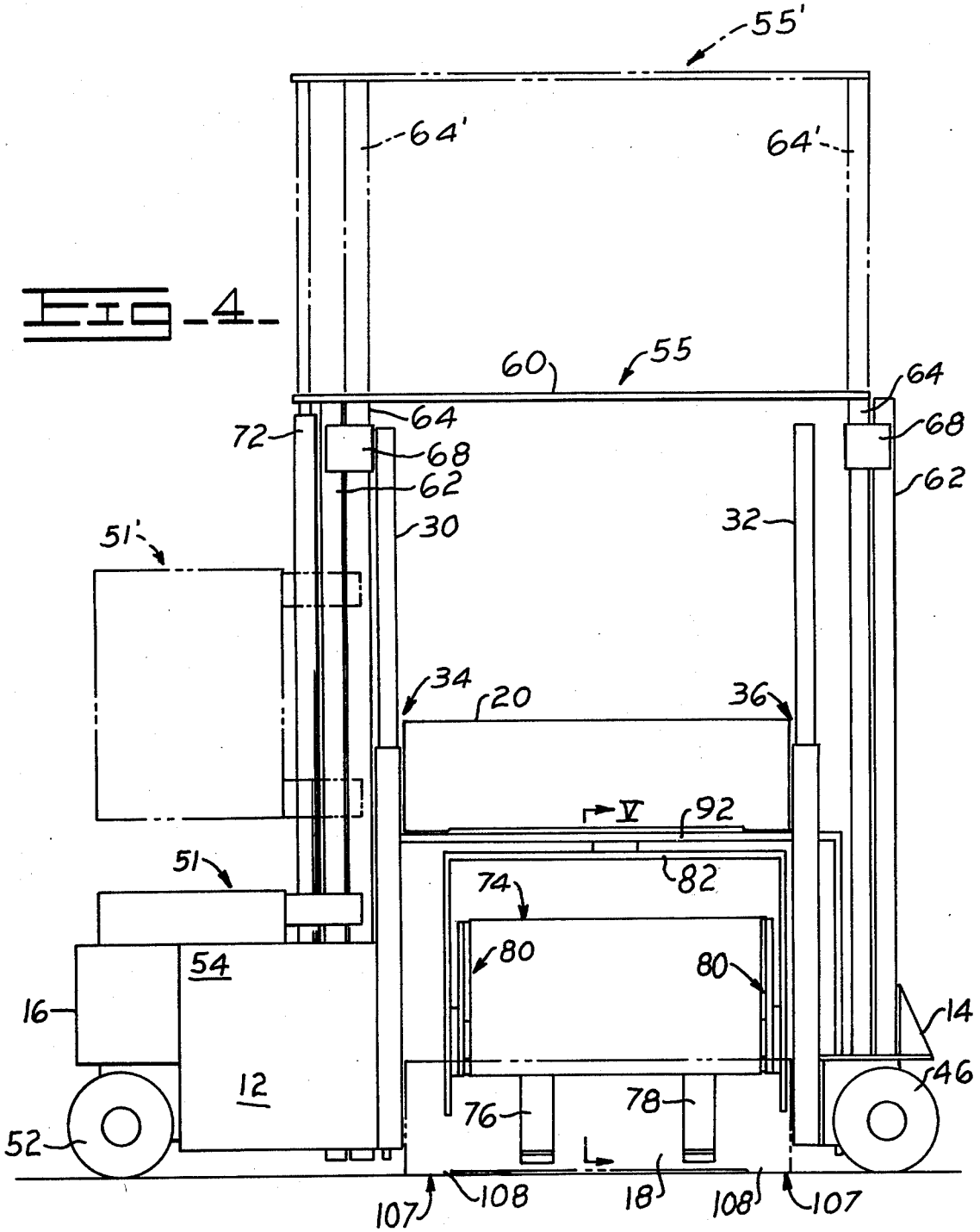
FIG. 4 is a view similar to FIG. 3, however showing the stabilizing and support members raised for traversing the carriage to a position outside the body of the vehicle.

As seen in FIGS. 2, 3 and 4, the vehicle mounts a carriage, shown generally at 74, which has a pair of horizontally directed forks 76,78 mounted thereon. The carriage is mounted for lateral movement on a pantograph arrangement 80, which is in turn mounted on a rotatable carriage support member 82 of generally U-shaped configuration.

Figure 5:
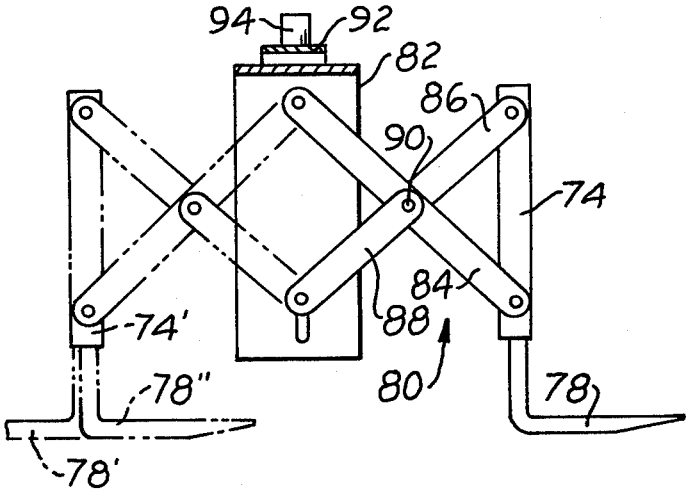
FIG. 5 is a side elevation view in partial cross section and taken along the lines V—V in FIG. 4, showing details of the pantograph arrangement.

As best seen in FIG. 5, the pantograph arrangement comprises a pair of X-shaped pantograph links 84,86,88. It should be noted that links 86 and 88 are on opposite sides of link 84 and are connected thereto by means of a pivot or shaft 90 passing through link 84. No further description of this pantograph arrangement will be made, since such is conventionally found in the art.

As may best be discerned in FIG. 5, the carriage support member 82 may be rotated vis-a-vis a vertically movable carriage support means 92 by means of a motor 94 mounted thereon, as will be more fully described hereinafter. It suffices to say that rotation of the carriage support member will enable the carriage to achieve position 74' after it has been first retracted into the vehicle envelope to position 78'' and then subsequently extended laterally to position 78'.

Figure 6:
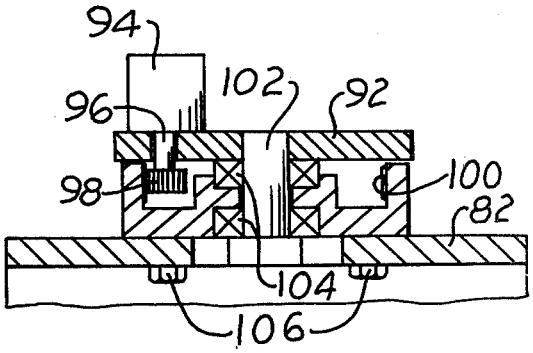
FIG. 6 is an enlarged view in partial cross section taken along the lines VI—VI in FIG. 3, showing details of the carriage support assembly and motor for rotating said carriage; and, FIG. 7 is a top-quarter isometric view of the chain mechanism for raising the carriage assembly.

As best seen in FIG. 6, the motor is connected by means of a shaft 96 extending through member 92 to a spur gear 98 which in turn drives a ring gear 100. Ring gear 100 is mounted for rotation on a vertically oriented pivot shaft 102 by means of a plurality of bearings 104. Bolt means 106 serve to conveniently mount carriage support member 82. The control means (not shown) for operating servo motor 94 may also be at operator station 51.

Returning to FIGS. 2–4, operation of the device may be briefly described. A load (not shown) is carried on forks 76,78 between the two outrigger and support members 18,20 and the vehicle is traversed down a narrow aisle. As seen in FIG. 4, the vehicle is positioned adjacent a load space and outrigger 20 on the side of the vehicle is raised to clear the carriage support 94 shortly thereafter or at the same time the remaining outrigger and support member 18 is lowered to a ground engaging position, as at 107. A pair of feet 108 on the support aid in stabilizing the vehicle during the traversing of the load by means of extending the pantograph assembly 80. When the load is picked up or deposited in the adjacent load space, it is again retracted within the body envelope.

If it is then desired to place the load into the upper load space at the same side of the vehicle, mast assembly 55 is raised to a higher load space. Of course, rotation of the load can provide for loading and unloading on the laterally opposite side of the vehicle.

Figure 7:
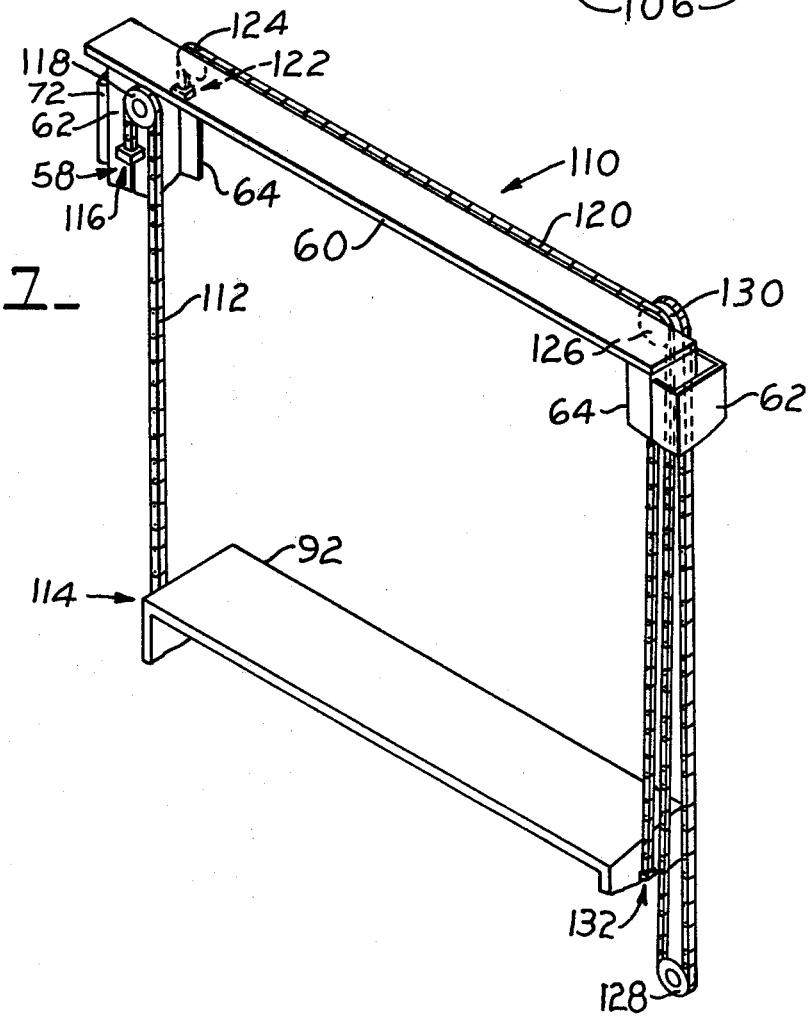

In FIG. 7, the chain mechanism for raising the carriage support member is shown generally at 110. The chain mechanism is seen to comprise a first chain fixed to carriage support member 92 at one end at 114 and to the outer upright member 58 at 116. Chain 112 is tracked over a pulley 118 on the other side of cross member 60. Similarly, a second, longer chain 120 is similarly fixed as at 122 and draped over a first pulley 124 at one end of cross member 60 and then over a second pulley 126 at the other end of cross member 60. The chain then drapes over a third pulley 128 fixed to outer upright 62 and thence upward over a fourth pulley 130 again fixed to cross member 60. From here, the end of the chain is fixed as at 132 to carriage support 92. In this manner, raising or lowering of the inner uprights and cross member 60 causes a corollary raising or lowering of carriage support member 92. As aforementioned, such raising or lowering is caused by means of cylinder 72. As seen in FIG. 3, carriage support member 92 is guided for vertical movement by a plurality of rollers 134,136,138,140 within the masts.

It is to be understood that the foregoing description is merely illustrative of a preferred embodiment of the invention, and that the scope of the invention is not to be limited thereto, but is to be determined by the scope of the appended claims.

What is claimed is:

1. A lift truck vehicle comprising a body defining discrete front and rear body portions, laterally opposite left and right outrigger and support assemblies connecting said discrete front and rear body portions, a mast assembly, including a front telescoping mast mounted on said front body portion and a rear telescoping mast mounted on said rear body portion, a u-shaped carriage, a pair of forks, said carriage mounting said pair of forks for load handling, and carriage support member means;

said carriage support member means comprising vertically movable u-shaped carriage support means movably mounted in said mast assembly for vertical movement of said carriage between said front and rear telescoping masts, said u-shaped carriage disposed within said vertically movable u-shaped carriage support means, carriage rotating means mounted in said vertically movable u-shaped carriage support means for rotation of said u-shaped carriage about a generally vertical axis, and a rotatable carriage support member mounted in said carriage rotating means for extending said u-shaped carriage from positions generally between said laterally opposite left and right outrigger and support assemblies to positions outside said laterally opposite left and right outrigger and support assemblies;

each said left and right outrigger and support assemblies including an outrigger and support member and front and rear vertically movable uprights mounted on said front and rear body portions respectively, each said outrigger and support member affixed to said front and rear vertically movable upright for movement therewith and for selective ground engagement or load clearance, so that with said vertically movable u-shaped carriage support means in its lowest position, one of said outrigger and support members may be positioned in a ground engaging position and the other of said outrigger and support members may be positioned higher than said vertically movable u-shaped carriage support means so that loads may be picked up and deposited on the ground outside of said other of said outrigger and support members.

2. The invention of claim 1 wherein said carriage rotating means comprises a servo motor interconnected between said vertically movable carriage support means and said rotatable carriage support member.

3. The invention of claim 1 wherein said rotatable carriage support member comprises a pantograph assembly.

* * * * *